US010011130B2

(12) United States Patent
Daigo et al.

(10) Patent No.: US 10,011,130 B2
(45) Date of Patent: Jul. 3, 2018

(54) SHEET STORAGE DEVICE AND IMAGE FORMING APPARATUS

(71) Applicant: KYOCERA Document Solutions Inc., Osaka-shi (JP)

(72) Inventors: Hironori Daigo, Osaka (JP); Takuya Nishimura, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/684,131

(22) Filed: Aug. 23, 2017

(65) Prior Publication Data

US 2018/0056680 A1 Mar. 1, 2018

(30) Foreign Application Priority Data

Aug. 29, 2016 (JP) ..... 2016-166776

(51) Int. Cl.

*B65H 1/00* (2006.01)
*B41J 13/00* (2006.01)
*G03G 15/00* (2006.01)

(52) U.S. Cl.

CPC ..... *B41J 13/0036* (2013.01); *G03G 15/6502* (2013.01); *B65H 2405/11* (2013.01); *B65H 2405/31* (2013.01); *B65H 2405/32* (2013.01); *B65H 2511/10* (2013.01); *B65H 2701/1131* (2013.01)

(58) Field of Classification Search

CPC ..... B41J 13/0036; G03G 15/6502; B65H 2405/11; B65H 2405/31; B65H 2405/32; B65H 2511/10; B65H 2701/1131; B65H 2511/12; B65H 1/00

See application file for complete search history.

(56) References Cited

U.S. PATENT DOCUMENTS 7,976,017 B2 * 7/2011 Shiohara ..... B65H 1/266 271/171
2006/0180981 A1 8/2006 Miki

FOREIGN PATENT DOCUMENTS

JP 2000-16601 * 1/2000
JP 2006-137597 6/2006

OTHER PUBLICATIONS

Machine translation of JP2000-16601. (Year: 2000).*

* cited by examiner

*Primary Examiner* — Thomas A Morrison
(74) *Attorney, Agent, or Firm* — Gerald E. Hespos; Michael J. Porco; Matthew T. Hespos

(57) ABSTRACT

A sheet storage device has a rotation restriction portion configured to restrict a rotation of an end cursor from a first posture to a second posture. The rotation restriction portion has: a restriction piece situated on the end cursor and configured to be brought into contact with a guide rail so as to restrict the rotation of the end cursor from the first posture to the second posture; and an engagement recess formed at a given position of the guide rail, the restriction piece being fitted in the engagement recess. The end cursor is allowed to rotate from the first posture to the second posture when the restriction piece is fitted in the engagement recess at the given position of the guide rail.

7 Claims, 6 Drawing Sheets

SHEET STORAGE DEVICE AND IMAGE FORMING APPARATUS

INCORPORATION BY REFERENCE

This application is based on Japanese Patent Application Serial No. 2016-166776 filed in Japan Patent Office on Aug. 29, 2016, the contents of which are hereby incorporated by reference.

BACKGROUND

The present disclosure relates to a sheet storage device and an image forming apparatus, each of which includes a detector configured to detect a size of sheets, the sheets being stored in a sheet feeding cassette.

A known sheet storage device includes a detector configured to detect a size of sheets which are stored in a sheet feeding cassette. This sheet storage device is used in an image forming apparatus such as a copier or a printer.

The sheet storage device has an end cursor inside the sheet feeding cassette, the end cursor being used for restricting a position of trailing edges of the sheets in a sheet feeding direction. The end cursor is slidable in the sheet feeding direction. When an operator slides and brings the end cursor into contact with the trailing edges of the sheets in the sheet feeding direction, the size of the sheets is detected by the detector.

SUMMARY

A sheet storage device according to one aspect of the present disclosure includes a sheet feeding cassette configured to store a sheet; an end cursor supported so as to rotate between a first posture, at which the end cursor protrudes upwardly from a bottom plate of the sheet feeding cassette, and a second posture, at which the end cursor is situated in parallel to the bottom plate, the end cursor in the first posture being brought into contact with trailing edge of the sheet in a sheet feeding direction; a guide rail extending on the bottom plate along the sheet feeding direction to guide a sliding movement of the end cursor; a detector configured to detect the size of the sheet based on a position of the end cursor in the sheet feeding direction; and a rotation restriction portion restricting a rotation of the end cursor from the first posture to the second posture, and including a restriction piece situated on the end cursor so as to be brought into contact with the guide rail and restrict the rotation of the end cursor from the first posture to the second posture; and an engagement recess formed at a given position of the guide rail so that the restriction piece is fitted in the engagement recess. The end cursor is allowed to rotate from the first posture to the second posture when the restriction piece is fitted in the engagement recess at the given position of the guide rail.

DESCRIPTION OF EMBODIMENTS

Figure 1:
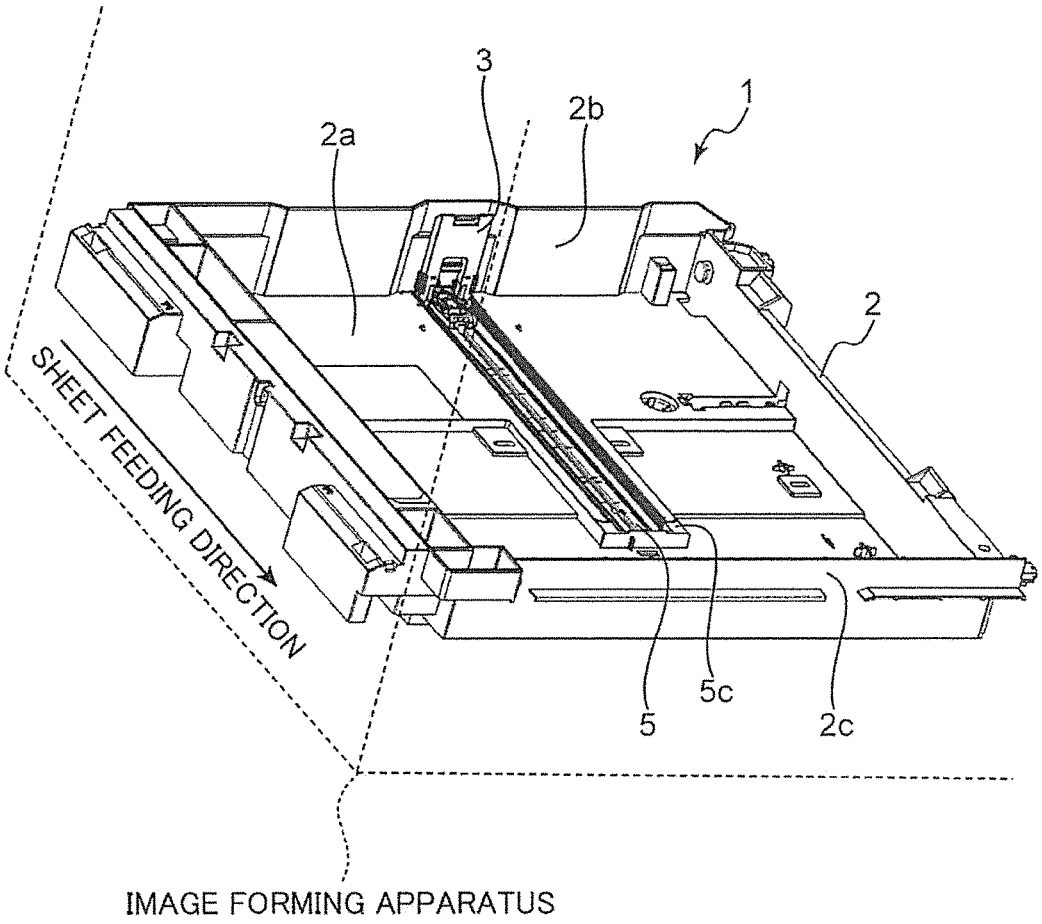
FIG. 1 is a perspective view showing an exemplificative sheet storage device.
Figure 2:
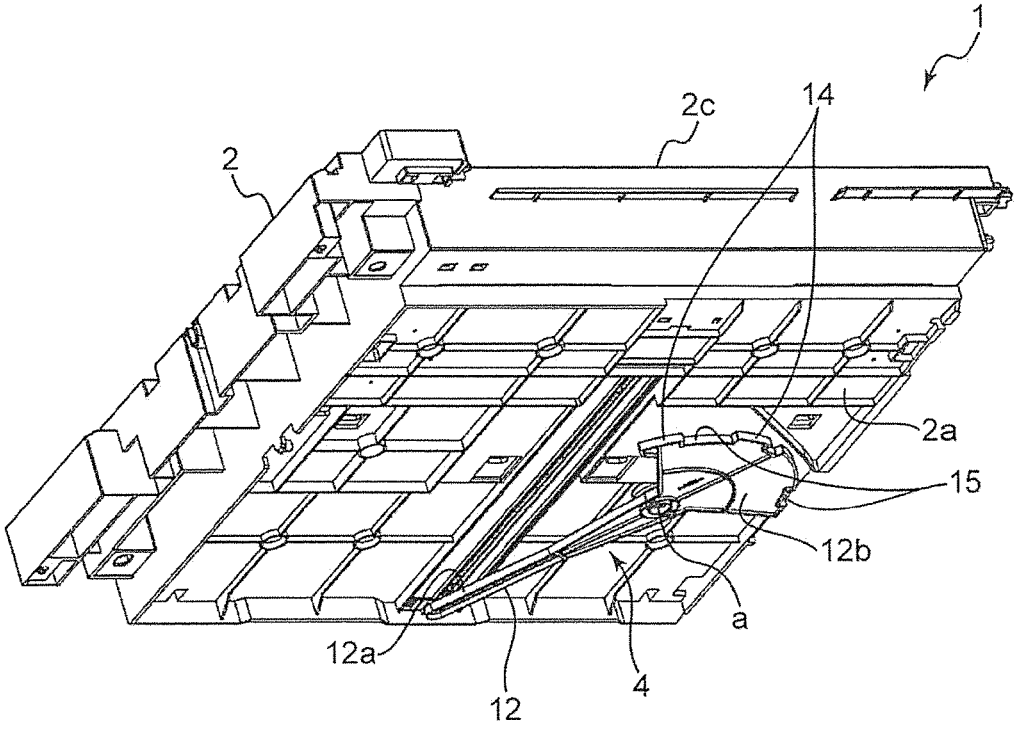
FIG. 2 is another perspective view showing the sheet storage device depicted in FIG. 1.
Figure 3:
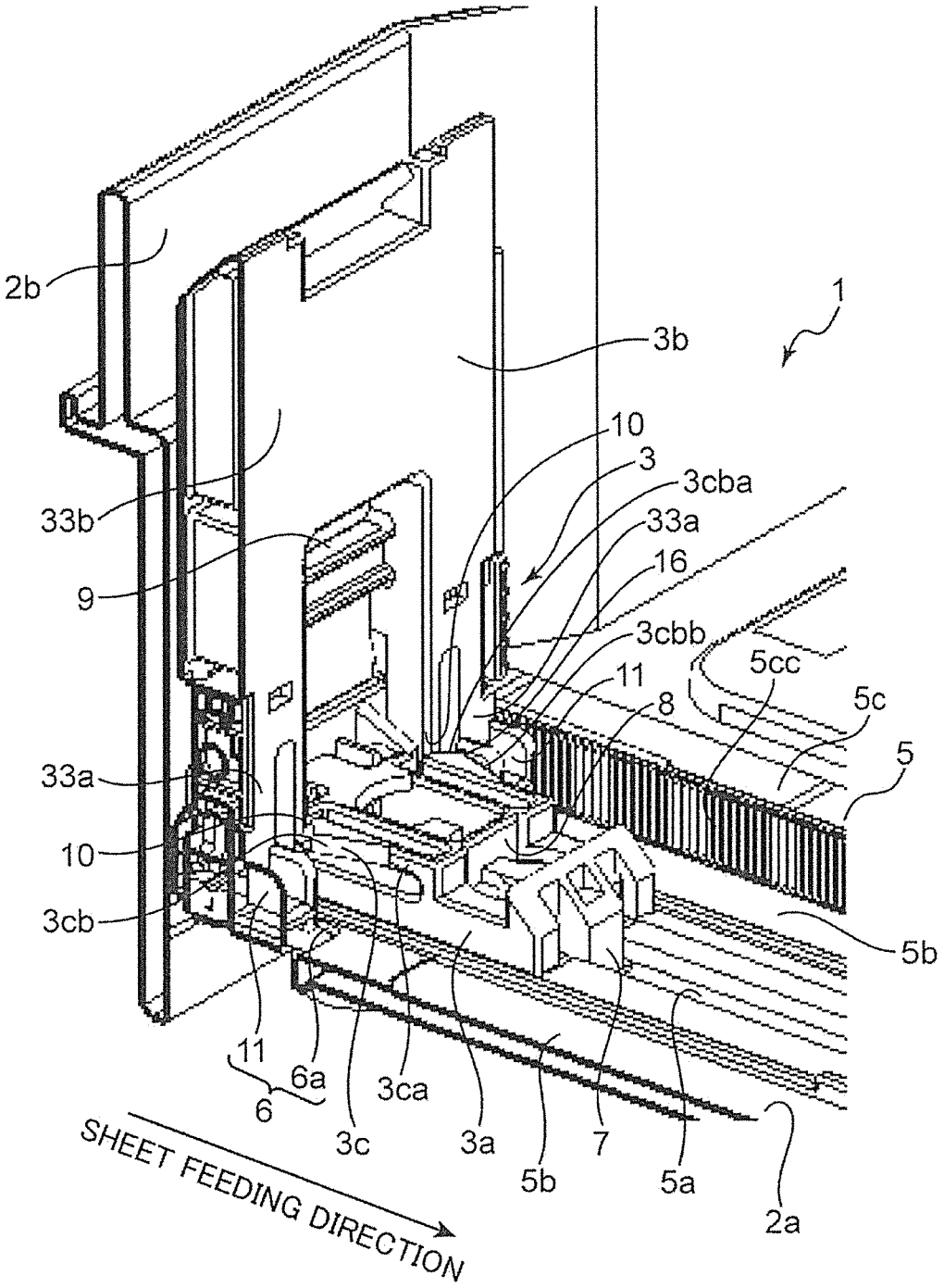
FIG. 3 is a perspective view showing an end cursor of the sheet storage device depicted in FIG. 1.

FIG. 1 is a perspective view showing an exemplificative sheet storage device 1. FIG. 2 is another perspective view showing the sheet storage device 1. FIG. 3 is a perspective view showing an end cursor 3 of the sheet storage device 1. As shown in FIG. 1, the sheet storage device 1 is stored in an image forming apparatus. The sheet storage device 1 includes: a sheet feeding cassette 2 configured to store sheets which are different in size; an end cursor 3 configured to restrict a position of the sheets in a sheet feeding direction; a detector 4 configured to detect the size of the sheets on the basis of a position of the end cursor 3 in the sheet feeding direction; and a rotation restriction portion 6 configured to restrict a rotation of the end cursor 3.

The sheet feeding cassette 2 is shaped in a box which is opened upwardly. The sheet feeding cassette 2 includes: a bottom plate 2*a* on which the sheets are placed, an upstream wall 2*b* which stands upwardly from an upstream end of the bottom plate 2*a* in the sheet feeding direction; and a downstream wall 2*c* which stands upwardly from a downstream end of the bottom plate 2*a* in the sheet feeding direction.

The bottom plate 2*a* of the sheet feeding cassette 2 has a rail portion 5 designed as a runway for the end cursor 3. The rail portion 5 includes: a rail groove 5*a* extending in the sheet feeding direction; two guide rails 5*b*, 5*b*, which are situated on both sides of the rail groove 5*a* and extend in the sheet feeding direction along the rail groove 5*a* to face a part of the end cursor 3; and a sidewall 5*c* which is shaped in a rectangular frame and protrudes upwardly from the bottom plate 2*a*. The rail groove 5*a* opened through the bottom plate 2*a* extends from a position adjacent to the upstream wall 2*b* to a vicinity of the downstream wall 2*c*. The two guide rails 5*b*, 5*b* are situated at an interval to be in parallel to the rail groove 5*a*. Each of the two guide rails 5*b*, 5*b* extends from a position adjacent to the upstream wall 2*b* to a vicinity of the downstream wall 2*c*. The sidewall 5*c* is situated on the bottom plate 2*a* so as to surround the rail groove 5*a* and the guide rails 5*b*, 5*b*. A rack 5*cc* having a lot of grooves configured to engage with an engagement pawl which is described below is formed on a surface of the sidewall 5*c* which extends in the sheet feeding direction and stand upright.

Figure 4:
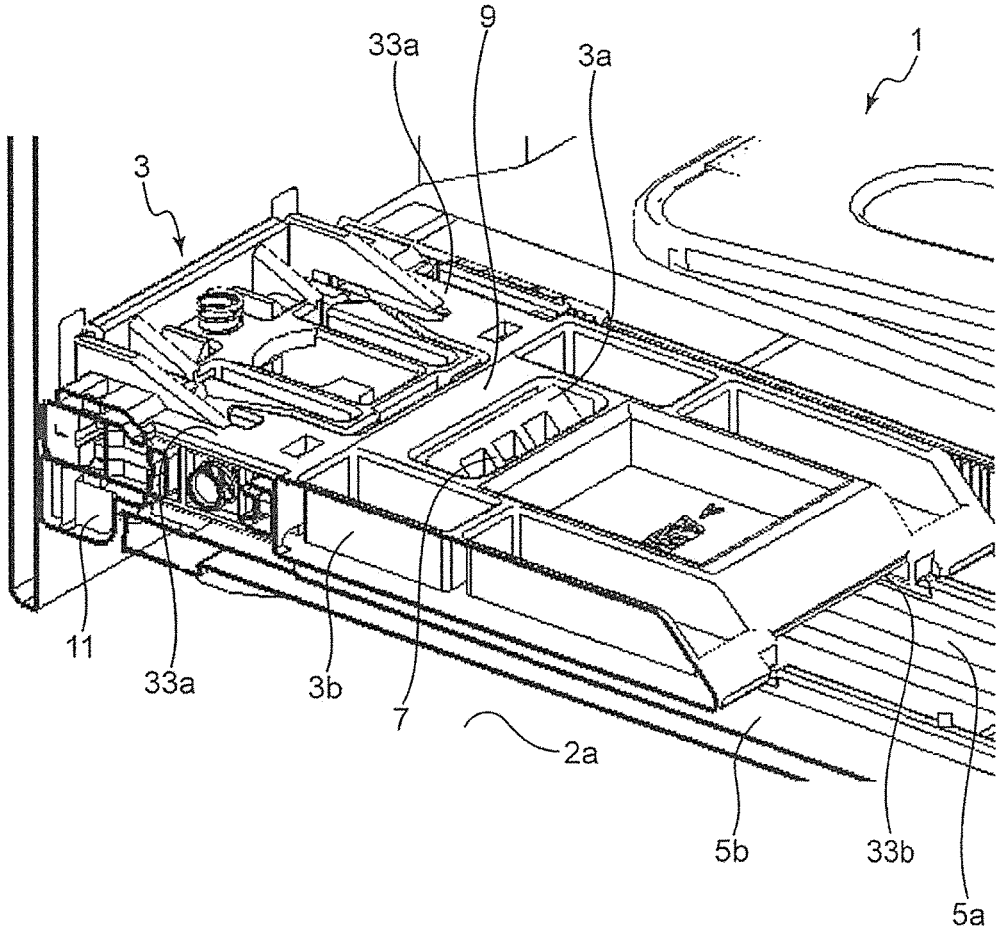
FIG. 4 is a perspective view showing a folded state of the end cursor depicted in FIG. 3.

FIG. 4 is a perspective view showing the end cursor 3 in a folded state. The end cursor 3 is described with reference to FIGS. 3 and 4. The end cursor 3 is slidable in the sheet feeding direction. The end cursor 3 includes a base plate 3*a* which is shaped substantially in a flat plate and configured to slide along the rail groove 5*a*; a cursor 3*b* which is brought in contact with trailing edges of the sheets in the sheet feeding direction; and a lock portion 3*c* (c.f. FIG. 3) for locking the cursor 3*b*. The base plate 3*a* is substantially rectangular. A downwardly convex engagement portion 7 is formed at a leading end of the base plate 3*a* in the sheet feeding direction, the engagement portion 7 being fitted in the rail groove 5*a*. Accordingly, the base plate 3*a* may be moved along the rail groove 5*a*. A fitting recess 8 is formed on an upper surface of the base plate 3*a*, a latch portion described below being fitted in the fitting recess 8.

The cursor 3*b* is formed in an inverse U shape. The cursor 3*b* has two leg portions 33*a*, 33*a*, which extend downwardly, and a base end portion 33*b* connecting the two leg portions

33*a*, 33*a* together. The cursor 3*b* is rotatable and attached to an upstream end of the base plate 3*a* so that the two leg portions 33*a*, 33*a* sandwiches both sides of the base plate 5*a*. Accordingly, the cursor 3*b* may be rotated between a first posture, at which the cursor 3*b* protrudes upwardly from the bottom plate 2*a*, and a second posture, at which the cursor 3*b* is situated in parallel to the bottom plate 2*a*. The cursor 3*b* in the first posture is brought into contact with the trailing edges of the sheets in the sheet feeding direction. The term "first posture" means not only an upright posture, in which the cursor 3*b* stands at a right angle with respect to the bottom plate 2*a*, but also a posture in which the cursor 3*b* is rotated slightly from the upright posture. The term "second posture" means not only a horizontal posture, in which the cursor 3*b* is in parallel to the bottom plate 2*a*, but also a posture, in which the cursor 3*b* is rotated slightly from the horizontal posture. The cursor 3*b* has a latch portion 9, which is situated underneath the base end portion 33*b*, the latch portion 9 being fitted into the fitting recess 8 to maintain a folded posture. The latch portion 9 is fitted into the fitting recess 8 when the cursor 3*b* is rotated to the second posture. Accordingly, the cursor 3*b* is stabilized at the second posture. When the cursor 3*b* is set in the second posture, each of the two leg portions 33*a*, 33*a* becomes in parallel to the guide rails 5*b*, 5*b*, so that the leg portions 33*a*, 33*a* face the guide rails 5*b*, 5*b*. The sliding movement of the end cursor 3 is guided by the guide rails 5*b*, 5*b* and the rail groove 5*a*.

Figure 5:
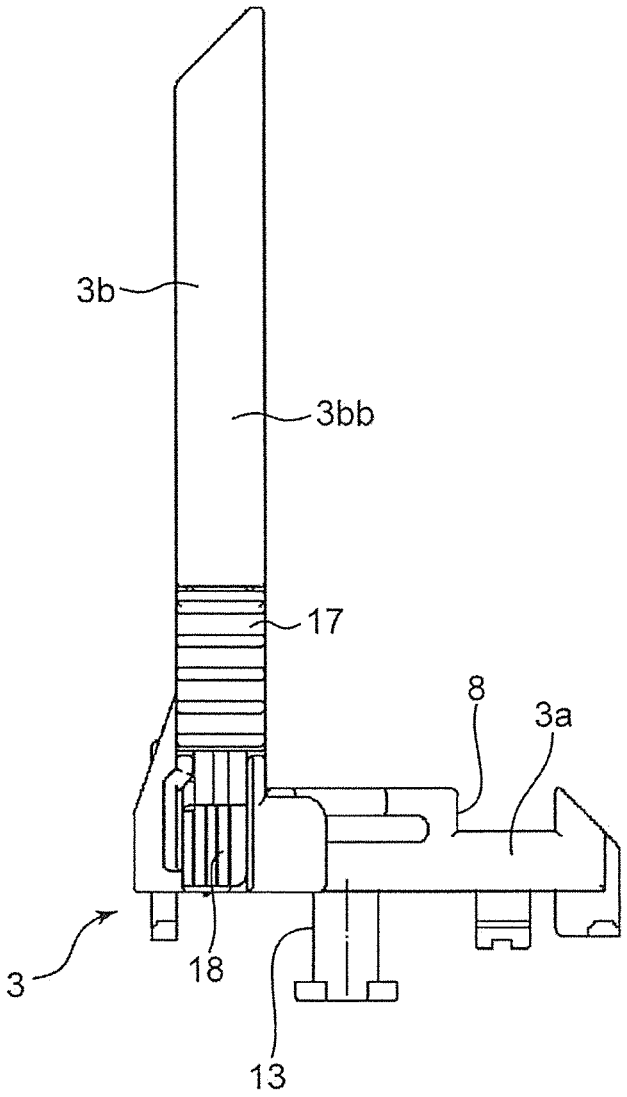
FIG. 5 is a side view showing the end cursor depicted in FIG. 3.

FIG. 5 is a side view showing the end cursor 3. The end cursor 3 is described with reference to FIGS. 2, 3 and 5. A grip portion 17, which protrudes outwardly in a width direction of the cursor 3*b*, and an engagement pawl 18, which is engaged with the rack cc (c.f. FIG. 3) of the sidewall 5*c* (c.f. FIG. 3) of the rail portion 5 are formed on a lateral surface 3*bb* of the cursor 3*b*. When an operator pinches the grip portion 17 by his/her fingers, the leg 33*a* of the cursor 3*b* is elastically deformed inwardly in the width direction, so that the engagement pawl 18 is disengaged from the rack 5*cc*. Accordingly, the end cursor 3 may be slid.

As shown in FIG. 3, the rotation restriction portion 6 includes two restriction pieces 11, 11, which are situated on lower ends of the two legs 33*a*, 33*a* of the cursor 3*b*, respectively, and two engagement recesses 6*a*, 6*a*, which are formed on the two guide rails 5*b*, 5*b*, respectively. Each of the two restriction pieces 11, 11 is shaped substantially in U shape opened upwardly. Each of the two restriction pieces 11, 11 protrudes from a respective one of the leg portions 33*a*, 33*a* of the cursor 3*b* in the first posture toward a downstream side in the sheet feeding direction. The two restriction pieces 11, 11 are fitted into and engaged with the engagement recesses 6*a*, 6*a*, respectively, when the cursor 3*b* is rotated to the second posture. Accordingly, the end cursor 3 is locked so as not to be moved toward the downstream side in the sheet feeding direction when the cursor 3*b* is in the second posture.

As shown in FIG. 3, the engagement recesses 6*a*, 6*a* are situated at respective positions of the guide rails 5*b*, 5*b*, each of which is adjacent to the upstream wall 2*b*. Each of the engagement recesses 6*a*, 6*a* is formed so as to be opened through a respective one of the guide rails 5*b*, 5*b* to a backside of the bottom plate 2*a*. Accordingly, a given position, at which each of the restriction pieces 11, 11 is engaged with a respective one of the engagement recesses 6*a*, 6*a*, is set at a position adjacent to the upstream wall 2*b* of the sheet feeding cassette 2.

As shown in FIG. 3, the lock portion 3*c* is situated on the upper surface of the base plate 3*a*. The lock portion 3*c* has a base end 3*ca* extending in a direction opposite to the sheet feeding direction, and a substantially triangle locking protrusion 3*cb* which protrudes from the base end 3*ca* outwardly in a width direction of the base plate 3*a*. The locking protrusion 3*cb* has a first inclined surface 3*cba*, which is brought obliquely in contact with a side edge 10 of an inner surface of each of the legs 33*a*, 33*a* of the cursor 3*b* set in the first posture, and a second inclined surface 3*cbb*, which connects the first inclined surface 3*cba* to the base end 3*ca*. Since the side edge 10 of the inner surface of each of the legs 33*a*, 33*a* is brought in contact with the first inclined surface 3*cba*, the cursor 3*b* is not rotated to the second posture even when a force acts to the cursor 3*b* in a direction causing a rotation of the cursor 3*b* from the first posture to the second posture. In short, the cursor 3*b* is locked in the first posture.

When a force causing elastic deformation of the base end 3*ca* is applied to the cursor 3*b* in the direction causing a rotation of the cursor 3*b* from the first posture to the second posture, the side edge 10 of the cursor 3*b* presses the first inclined surface 3*cba*. Accordingly, the base end 3*ca* is elastically deformed inwardly in the width direction of the base plate 3*a*. Meanwhile, the side edge 10 of the cursor 3*b* is slid on the first inclined surface 3*cba* in a direction toward an apex 16 of the locking protrusion 3*cb*. When the side edge 10 of the cursor 3*b* is moved beyond the apex 16, the rotation of the cursor 3*b* toward the second posture is facilitated by an elastic restoring force of the base end 3*ca* acting on the cursor 3*b* outwardly in the width direction of the base plate 3*a*.

The detector 4 shown in FIG. 2 includes a size detection lever 12 configured to be swung on a backside of the sheet feeding cassette 2, and a size detection sensor (not shown) which detects a position of the size detection lever 12 and outputs an electrical signal on the basis of the detected position. The size detection sensor is placed in an apparatus body (not shown) of the image forming apparatus in which the sheet storage device 1 is placed. The placement of the size detection sensor is not limited to the apparatus body. For example, the size detection sensor may be placed in the sheet feeding cassette 2.

As shown in FIG. 2, the size detection lever 12 is situated on the backside of the bottom plate 2*a* of the sheet feeding cassette 2. The size detection lever 12 includes a follower arm portion 12*a*, which is shaped in a rod and coupled to a protrusion shaft 13 (c.f. FIG. 5) protruding downwardly from a back surface side of the base plate 3*a* (c.f. FIG. 3) of the end cursor 3 (c.f. FIG. 3) and extending through the rail groove 5*a* (c.f. FIG. 3), and a sector portion 12*b* formed at a distal end of the follower arm portion 12*a*. A rotational pivot a is situated around a boundary between the follower arm portion 12*a* and the sector portion 12*b*. An elongated guide hole (not shown) extending in a length direction of the follower arm portion 12*a* is formed at a side of a proximal end of the follower arm portion 12*a*. The protrusion shaft 13 is fitted in the guide hole. Accordingly, the protrusion shaft 13 may be moved along the rail groove 5*a* and the guide hole during movement of the end cursor 3. The size detection lever 12 is rotated about the rotational pivot a during the movement of the protrusion shaft 13.

As shown in FIG. 2, convex portions 14, each of which protrudes radially outwardly, and concave portions 15, each of which is depressed radially inwardly, are alternately formed along an arc-shaped peripheral edge of the sector portion 12*b*. The size detection sensor outputs different electrical signals in response to a positional relationship between the convex portions 14 and the concave portions 15. Accordingly, a position of each of the convex portions 14 and the concave portions 15 with respect to the size detection sensor are set so that an electrical signal is output from the size detection sensor on the basis of the positions when the trailing edges of the sheets in the sheet feeding direction come into contact with the cursor 3*b* of the end cursor 3.

The sheet storage device 1 operates as described below. If sheets having a size other than the maximum size are stored in the sheet feeding cassette 2, an operator slides the end cursor 3 along the guide rails 5*b*, 5*b* at first to bring the cursor 3*b* into contact with trailing ends of the sheets in the sheet feeding direction. Accordingly, an electrical signal based on the position of the end cursor 3 is output from the size detection sensor, so that the size of the sheets is detected.

On the other hand, if sheets having the maximum size are stored in the sheet feeding cassette 2, an operator slides the end cursor 3 to the given position set at a position adjacent to the upstream wall 2*b* of the sheet feeding cassette 2, as shown in FIG. 1, and then rotates the cursor 3*b* from the first posture to the second posture, as shown in FIG. 4. Meanwhile, the restriction pieces 11, 11 are fitted into the engagement recesses 6*a*, 6*a*, respectively, so as to allow the rotation of the cursor 3*b* from the first posture to the second posture. The operator then stores the sheets having the maximum size in the sheet feeding cassette 2 so that the trailing edges of the sheets in the sheet feeding direction are brought into contact with the upstream wall 2*b* of the sheet feeding cassette 2. Meanwhile, an electrical signal based on the position of the end cursor 3 is output from the size detection sensor, so that the maximum size of the sheets is detected. Since the upstream wall 2*b* of the sheet feeding cassette 2 is used as a reference for setting the position of the trailing edges of the sheets having the maximum size, as described above, it may be possible to realize a design for increasing a detectable sheet size without causing an increase in size of the sheet storage device 1.

Figure 6:
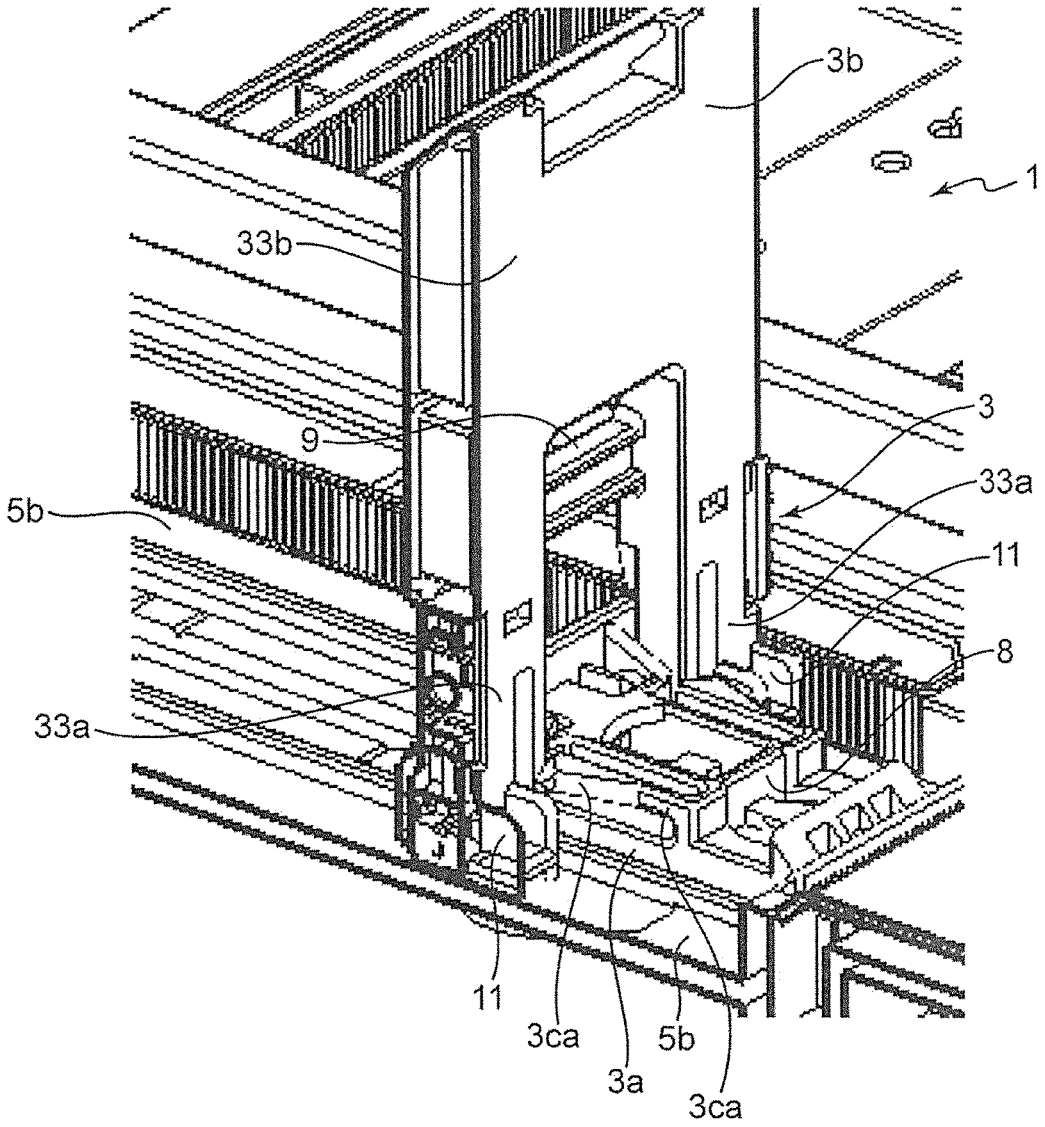
FIG. 6 is a perspective view showing the end cursor located at a position distant from a given position.

FIG. 6 is a perspective view showing the end cursor 3 located at a position distant from the given position. The end cursor 3 is described with reference to FIGS. 3, 4 and 6. The restriction pieces 11, 11 located at a position distant from the given position are brought into contact with the guide rails 5*b*, 5*b*, respectively, even when an operator rotates the cursor 3*b* of the end cursor 3 from the first posture toward the second posture. Accordingly, the operator may not fold the end cursor 3. Therefore, it is prevented for the operator to erroneously put sheets on the end cursor 3 located at a position distant from the given position. Therefore, the sheet storage device 1 is less likely to cause a false detection, in which a sheet size is detected on the basis of a position of the end cursor 3 distant from the given position.

As shown in FIG. 4, when the cursor 3*b* is in the second posture at the given position, the restriction pieces 11, 11 are engaged with the engagement recesses 6*a*, 6*a* (c.f. FIG. 3), respectively. Accordingly, even when a force acts on the end cursor 3 in the sheet feeding direction, the end cursor 3 is less likely to be displaced. Therefore, the sheet storage device 1 is less likely to cause a false detection of sheet size.

With regard to the aforementioned embodiment, the given position in the sheet feeding direction is set at one position adjacent to the upstream wall 2*b* of the sheet feeding cassette 2. Alternatively, a plurality of given positions may be set in the sheet feeding direction.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet storage device comprising:

a sheet feeding cassette having a bottom plate and configured to store a sheet on the bottom plate;

a guide rail extending on the bottom plate along a sheet feeding direction;

an end cursor including a substantially flat base plate that is slidable along the guide rail and a cursor attached to the base plate so as to rotate between a first posture, at which the cursor protrudes from the bottom plate of the sheet feeding cassette and is aligned to contact a trailing edge of the sheet in the sheet feeding direction, and a second posture, at which the cursor faces toward the bottom plate;

a detector configured to detect a size of the sheet based on a position of the end cursor in the sheet feeding direction; and a rotation restriction portion restricting a rotation of the cursor from the first posture to the second posture, the rotation restriction portion including a restriction piece situated on the end cursor so as to be brought into contact with the guide rail and to restrict the rotation of the cursor from the first posture to the second posture; and an engagement recess formed at a given position of the guide rail so that the restriction piece is fitted in the engagement recess, and the cursor is allowed to rotate from the first posture to the second posture so that the restriction piece is fitted in the engagement recess at the given position of the guide rail, thereby fixing the end cursor to the guide rail so as not to move in the sheet feeding direction.

2. The sheet storage device according to claim 1, wherein the restriction piece of the rotation restriction portion is engaged with the engagement recess when the end cursor is in the second posture.

3. The sheet storage device according to claim 1, wherein the sheet feeding cassette includes an upstream wall standing at an upstream of the end cursor in the sheet feeding direction, the guide rail has an upstream end located at a position adjacent to the upstream wall, and the given position of the guide rail is in correspondence to a position at which the end cursor is placed at the upstream end of the guide rail.

4. The sheet storage device according to claim 3, wherein the end cursor is in the second posture and the upstream wall restricts the trailing edge of the sheet when the sheet having a maximum size acceptable for storage is accommodated in the sheet feeding cassette.

5. The sheet storage device according to claim 1, wherein the restriction piece is brought into contact with the guide rail while the end cursor located at a position distant from the given position is rotated from the first posture toward the second posture.

6. The sheet storage device according to claim 1, wherein the end cursor includes a lock portion provided on an upper surface of the base plate, the lock portion being brought in contact with the cursor to lock the cursor in the first posture.

7. An image forming apparatus comprising the sheet storage device according to claim 1.

* * * * *